US009912054B2

(12) United States Patent
Topak et al.

(10) Patent No.: US 9,912,054 B2
(45) Date of Patent: Mar. 6, 2018

(54) ANTENNA ARRAY AND METHOD

(71) Applicant: Robert Bosch GmbH, Stuttgart (DE)

(72) Inventors: Ali Topak, Stuttgart (DE); Juergen Hasch, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 461 days.

(21) Appl. No.: 14/409,676

(22) PCT Filed: Apr. 24, 2013

(86) PCT No.: PCT/EP2013/058436

§ 371 (c)(1),
(2) Date: Dec. 19, 2014

(87) PCT Pub. No.: WO2013/189634

PCT Pub. Date: Dec. 27, 2013

(65) Prior Publication Data

US 2015/0325926 A1 Nov. 12, 2015

(30) Foreign Application Priority Data

Jun. 19, 2012 (DE) ..... 10 2012 210 314

(51) Int. Cl.
*H01Q 3/00* (2006.01)
*H01Q 3/26* (2006.01)
(Continued)

(52) U.S. Cl.
CPC ..... *H01Q 3/26* (2013.01); *H01Q 3/28* (2013.01); *H01Q 3/36* (2013.01);
(Continued)

(58) Field of Classification Search
CPC .. H01Q 3/36; H01Q 3/26; H01Q 3/22; H01Q 3/42; H01Q 21/0006; H01Q 21/065; H01Q 21/08
(Continued)

(56) References Cited

U.S. PATENT DOCUMENTS 4,364,052 A * 12/1982 Ohm ..... H01Q 3/2658 343/781 CA
5,920,809 A * 7/1999 Clarke ..... H04B 7/0814 342/368
(Continued)

FOREIGN PATENT DOCUMENTS

CA 2217730 A1 9/1997
DE 10 2010 040793 3/2012
(Continued)

*Primary Examiner* — Chuong P Nguyen
(74) *Attorney, Agent, or Firm* — Norton Rose Fulbright US LLP; Gerard Messina

(57) ABSTRACT

An antenna array, in particular a traveling-wave antenna array, has an adjustable radiation pattern, having an antenna element that has a first feed terminal at one end of the antenna element and a second feed terminal at another end of the antenna element; a signal generation unit that is configured for generating a feed signal and for providing a feed signal at the first feed terminal of the antenna element and at the second feed terminal of the antenna elements; at least one signal conditioning unit that is electrically configured between the signal generation unit and one of the feed terminals and that is configured for matching the amplitude and/or the phase of the corresponding feed signal to a specified radiation pattern. Also described is a corresponding method.

9 Claims, 6 Drawing Sheets

(51) Int. Cl.

| | |
|---|---|
| ***H01Q 3/28*** | (2006.01) |
| ***H01Q 3/36*** | (2006.01) |
| ***H01Q 21/00*** | (2006.01) |
| ***H01Q 21/06*** | (2006.01) |
| *H01Q 1/38* | (2006.01) |
| *H01Q 13/20* | (2006.01) |
| *H01Q 21/08* | (2006.01) |

(52) U.S. Cl.
CPC ..... *H01Q 21/0006* (2013.01); *H01Q 21/065* (2013.01); *H01Q 1/38* (2013.01); *H01Q 13/20* (2013.01); *H01Q 21/08* (2013.01)

(58) Field of Classification Search
USPC ..... 342/368, 369, 371, 372
See application file for complete search history.

(56) References Cited

U.S. PATENT DOCUMENTS 6,043,779 A * 3/2000 Lalezari ..... H01Q 3/26 342/371
6,144,344 A * 11/2000 Kim ..... H01Q 1/246 343/700 MS
6,320,542 B1 * 11/2001 Yamamoto ..... H01Q 1/38 343/700 MS
6,320,642 B1 11/2001 Yamayoto et al.
7,683,833 B2 * 3/2010 Floyd ..... H01Q 3/30 342/372
9,118,113 B2 * 8/2015 Mortazawi ..... H01Q 3/30
2009/0298421 A1 * 12/2009 Andersson ..... H04B 7/1555 455/11.1
2013/0265195 A1 * 10/2013 Kenington ..... H01Q 1/246 342/368
2017/0133757 A1 * 5/2017 Hasch ..... H01Q 3/26

FOREIGN PATENT DOCUMENTS

| | | |
|---|---|---|
| GB | 2164498 A | 3/1986 |
| JP | 2005 020368 | 1/2005 |
| WO | 2007/004932 | 1/2007 |
| WO | 2012/041567 | 4/2012 |

* cited by examiner

ANTENNA ARRAY AND METHOD

FIELD OF THE INVENTION

The present invention relates to an antenna array, in particular a traveling-wave antenna array, having an adjustable radiation pattern. The present invention also relates to a method for operating an antenna array.

BACKGROUND INFORMATION

There are many applications where it is desired or necessary to use an antenna to radiate electromagnetic waves. In particular, some applications require that the electromagnetic waves be emitted with a specified directivity.

For example, in radar applications, it is advantageous for a certain directivity to be used to emit electromagnetic waves in order to correlate the electromagnetic waves reflected off of and received at an object to the position of the object. Cellular radio is another application where a certain directivity is desirable for the emission of electromagnetic waves. For example, a plurality of radio antennae are mounted on radio towers of the cellular radio system providers that each cover a specific area of the radio cell serviced by the particular radio tower. For example, three antennae may be provided, each of which has an approximately 120° angle of aperture.

In radar applications in particular, the direction in which the electromagnetic waves are emitted must be varied to be able to monitor a relatively large spatial area using the radar. Movable or swivel-mounted antennae are used, for example.

Such antennae require a mechanical system that allows the antenna that is mounted thereon to move in an appropriate way.

What are generally referred to as phased array antennae are also known today, where the antenna radiation pattern is electronically steerable. Phased array antennae are composed of a plurality of transmitting elements (array) that are fed from a common signal source. To steer the antenna radiation pattern of such a phased array antenna, the individual transmitting elements of the phased array antenna are controlled by a suitably phase-shifted signal. As a result, the individual emitted electromagnetic waves are superimposed on one another in the desired direction, producing a constructive interference, thereby forming a maximum of emitted energy in the desired direction.

Such phased array antennae include a phase shifter and an attenuator in order to individually adjust the phase and amplitude for each of the transmitting elements.

An exemplary phased array antenna is shown in FIG. 1. The phased array antenna of FIG. 1 has four transmitting elements S1-S4 that are each coupled to a common signal source FN (also referred to as feed network). An attenuator V1-V4, as well as a phase shifter P1-P4 disposed in series relative thereto are located between signal source FN and the individual transmitting elements.

German Patent Application DE 102010040793 (Al), for example, discusses an antenna that is suited for use in radar applications.

SUMMARY OF THE INVENTION

The present invention describes an antenna array having the features described herein and a method having the features described herein.

Provided accordingly are:

An antenna array, in particular a traveling-wave antenna array, having an adjustable radiation pattern; having an antenna element that has a first feed terminal at one end of the antenna element and a second feed terminal at another end of the antenna element; a signal generation unit that is configured for generating a feed signal and for providing the feed signal at the first feed terminal of the antenna element and at the second feed terminal of the antenna element; and having at least one signal conditioning unit that is electrically configured between the signal generation unit and one of the feed terminals and that is configured for matching the amplitude and/or the phase of the corresponding feed signal to a specified radiation pattern.

A method for operating an antenna array in accordance with one of the preceding claims, including the steps of generating a feed signal; injecting the feed signal at a first feed terminal of an antenna element of the antenna array and at a second feed terminal of the antenna element of the antenna array; a conditioned feed signal being injected at at least one of the feed terminals; and, upon conditioning of the feed signal, the amplitude and/or the phase of the feed signal being matched to a specified radiation pattern.

Underlying the present invention is the realization that an antenna, which is fed two feed signals, emits two independent signals that are superimposable on one another.

At the core of the present invention is the idea of allowing for this realization and of providing a way for feeding an individual antenna with two feed signals that are conditioned in a way that allows the superimposition of the two electromagnetic waves produced by the feed signals to feature a desired property, such as a directivity, for example.

For that purpose, the present invention provides a signal generation unit that generates a feed signal which is supplied to two individual feed points of an antenna element. To adjust the antenna radiation pattern, the present invention also provides a signal conditioning unit that conditions the feed signal for at least one of the two feed points, thereby resulting in a desired antenna radiation pattern from the emitted electromagnetic waves. For that purpose, the signal conditioning unit matches, in particular, the amplitude and the phase of the feed signal that is fed to one of the feed terminals.

If electromagnetic waves are emitted with a directivity, it is usually not possible to precisely limit the area in which the electromagnetic waves are emitted. Rather, a maximum of electrical energy is transmitted into the indicated direction. Therefore, depending on the amplitude and phase adjustment of the control signals that are injected at the feed points of the antenna element, the direction and width of the main antenna lobe may be adjusted with the aid of the present invention.

In particular, the direction and width of the main antenna lobe may be adjusted using only one signal conditioning unit that merely conditions the feed signal which is fed to one of the two feed points.

In addition, the present invention makes it possible to provide an antenna device with an antenna radiation pattern that is extremely insensitive to amplitude and phase errors of the feed signals.

Advantageous specific embodiments and refinements are derived from the dependent claims, as well as from the description, with reference being made to the figures.

In one specific embodiment, the antenna element has an array antenna which, at one end, features one of the feed terminals. This makes it possible to provide an antenna element that is not very complex and is simple to manufacture and that may be used to adjust a desired antenna radiation pattern.

In one specific embodiment, the array antenna has a waveguide antenna. Additionally or alternatively, the array antenna has a microstrip antenna. This makes it possible to adapt the present invention to different applications and requirements.

In one specific embodiment, the feed signal has a frequency that is adapted to the antenna element in a way that allows an electromagnetic wave emitted by the antenna element to have a specified radiation pattern. In the context of the inventive antenna configuration, this makes it possible to already define a desired directivity pattern of the main antenna lobe based on the geometry of the antenna element and a feed signal tuned thereto, without the signal conditioning unit having to alter the signal.

In one specific embodiment, the at least one signal conditioning unit is configured for matching the amplitude and/or the phase of the feed signal in a way that allows the waves produced by the feed signal injected at the first feed terminal and at the second feed terminal and radiated by the antenna element to be superimposed on one another in such a way that a superimposed wave emitted by the antenna element has the specified, modified radiation pattern. This makes it possible to dynamically vary the direction and width of the main antenna lobe of the antenna configuration according to the present invention in accordance with a desired radiation pattern.

In one specific embodiment, the signal conditioning unit has a variable phase shifter. This makes it possible to provide a simple signal conditioning unit that is based on few components.

In one specific embodiment, the signal conditioning unit has a variable amplifier. This likewise makes it possible to provide a simple signal conditioning unit that is based on few components.

The above embodiments and refinements may be combined in any desired, useful manner. Other possible embodiments, refinements and implementations of the present invention also include combinations that are neither explicitly named previously nor in the following with regard to exemplary embodiments of described features of the present invention. In particular, one skilled in the art would also add individual aspects as improvements or supplements to the particular basic design of the present invention.

The present invention is explained in greater detail in the following on the basis of exemplary embodiments indicated in the schematic figures of the drawings.

In all of the figures, like or functionally corresponding elements and devices—provided that nothing else is specified—are provided with the same reference numerals.

DETAILED DESCRIPTION

Figure 1:
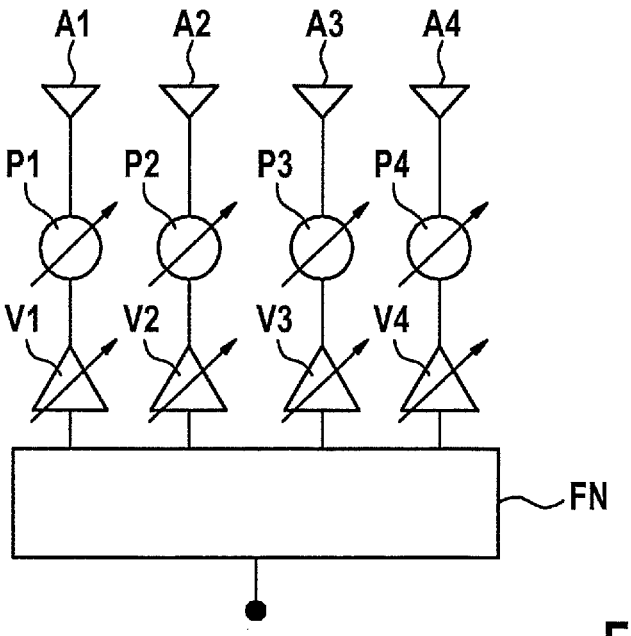
FIG. 1 shows an exemplary conventional phased array antenna.
Figure 2:
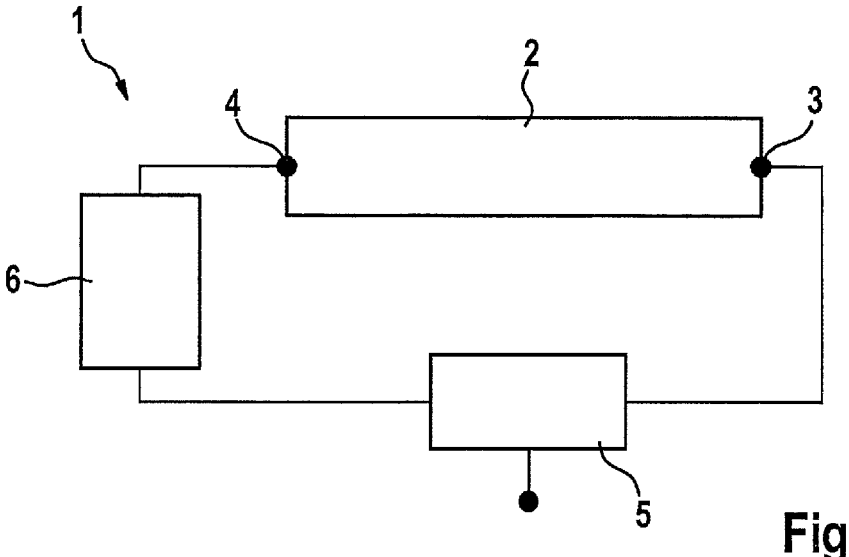
FIG. 2 shows a block diagram of an exemplary specific embodiment of an antenna array according to the present invention.

FIG. 2 shows a block diagram of an exemplary specific embodiment of an antenna array 1 according to the present invention.

Antenna array 1 has an antenna element 2 that has a first feed terminal 3 at one end and a second feed terminal 4 at the other end thereof. In addition, antenna array 1 has a signal generation unit 5 that is directly coupled to first feed terminal 3. Signal generation unit 5 is indirectly coupled to second feed terminal 4 via a signal conditioning unit 6 that is configured for matching the amplitude and/or the phase of the corresponding feed signal to a specified radiation pattern.

Figure 5:
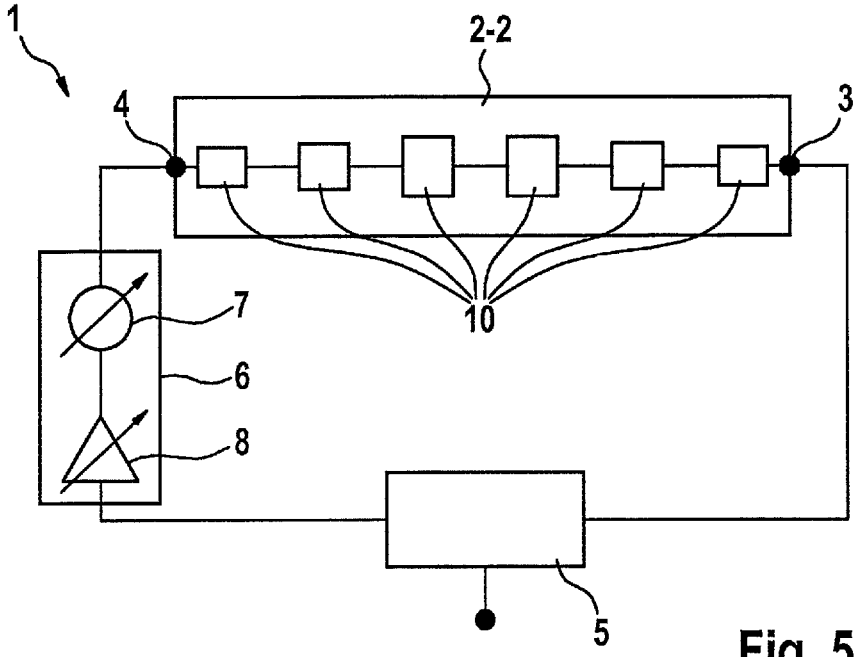
FIG. 5 shows a block diagram of another exemplary specific embodiment of an antenna array according to the present invention.
Figure 6:
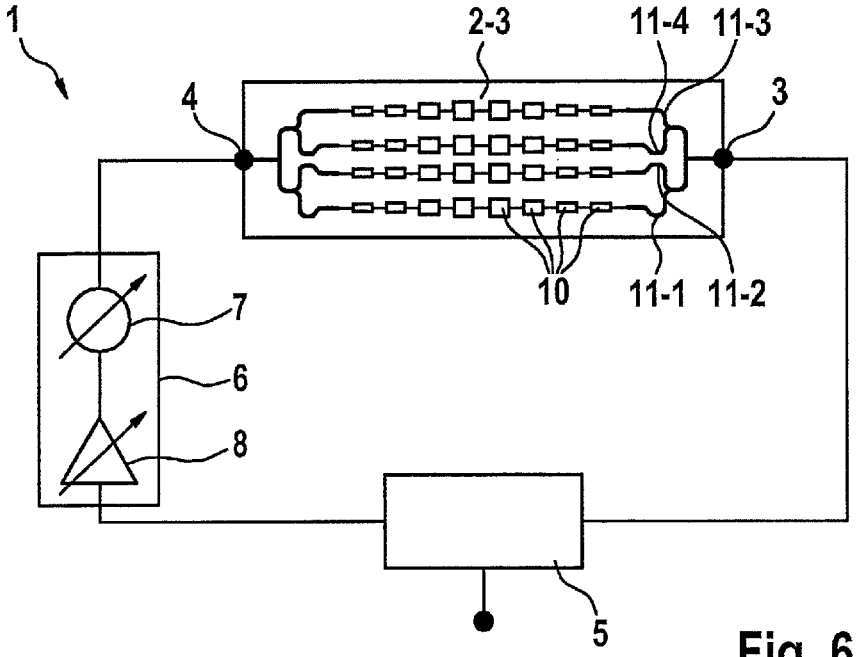
FIG. 6 shows a block diagram of another exemplary specific embodiment of an antenna array according to the present invention.

Thus, FIG. 2 shows a dual-fed antenna element 2 that is simultaneously fed from both sides. This may be a linear array antenna, for example. Other exemplary specific embodiments of antenna array 1 are shown in FIG. 4 through 6.

Figure 3:
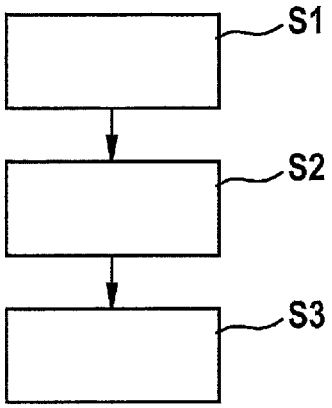
FIG. 3 shows a flow chart of an exemplary specific embodiment of a method according to the present invention.

FIG. 3 shows a flow chart of an exemplary specific embodiment of a method according to the present invention.

In a first step S1 of the method according to the present invention, a feed signal is generated. In addition, in a second step S2, the feed signal is injected at a first feed terminal 3 of an antenna element 2 of antenna array 1 and at a second feed terminal 4 of antenna element 2 of antenna array 1. In this context, however, a conditioned feed signal is injected at at least one of feed terminals 3, 4. This conditioned feed signal is adjusted in a third step S3 in that the amplitude and/or the phase of the feed signal are/is matched to a specified radiation pattern.

Figure 4:
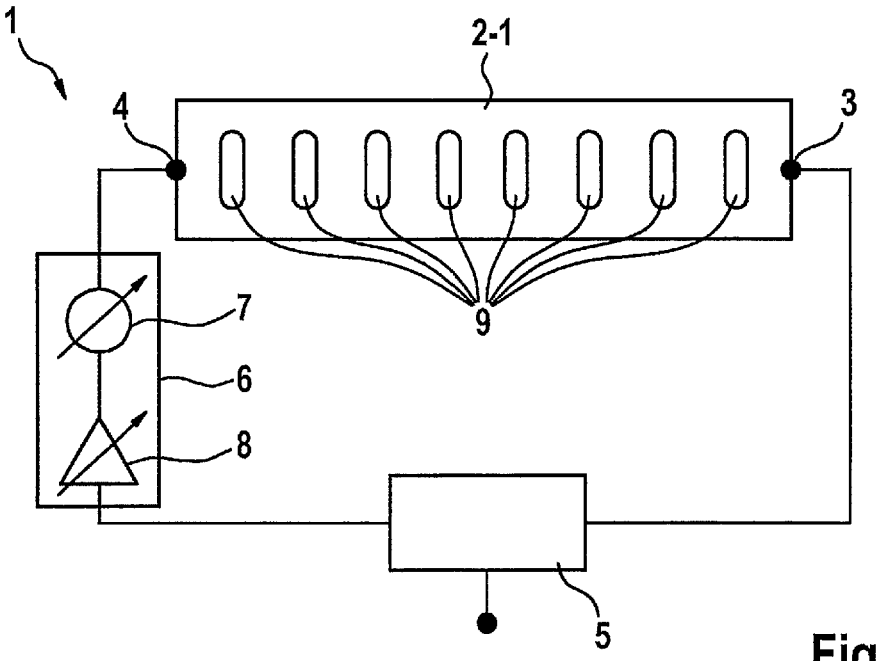
FIG. 4 shows a block diagram of another exemplary specific embodiment of an antenna array according to the present invention.

FIG. 4 shows a block diagram of another exemplary specific embodiment of an antenna array 1 according to the present invention.

Antenna array 1 in FIG. 4 corresponds substantially to that of FIG. 2. Antenna array 1 of FIG. 4 differs from that of FIG. 2 merely in that antenna element 2 is configured as a waveguide antenna element 2-1 that includes only one antenna gap, and in that signal conditioning unit 6 includes a variable phase shifter 7 and a variable amplifier 8.

FIG. 5 shows a block diagram of another exemplary specific embodiment of an antenna array 1 according to the present invention.

Antenna array 1 in FIG. 5 corresponds substantially to that of FIG. 4. Antenna array 1 of FIG. 5 differs from that of FIG. 4 merely in that antenna element 2 is configured as a patch array antenna 2-2 that includes only one antenna gap.

FIG. 6 shows a block diagram of another exemplary specific embodiment of an antenna array 1 according to the present invention.

Antenna array 1 in FIG. 6 corresponds substantially to that of FIG. 4. Antenna array 1 of FIG. 6 differs from that of FIG. 4 merely in that antenna element 2 is configured as a patch array antenna 2-2 that includes four antenna gaps 11-1, 11-2, 11-3, 11-4.

Figure 7:
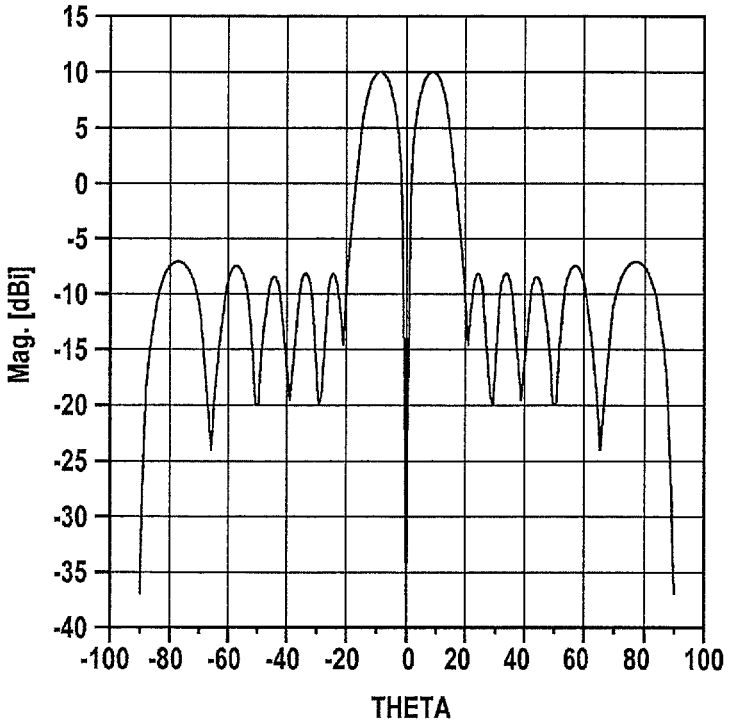
FIG. 7 shows an antenna radiation pattern of another exemplary specific embodiment of an antenna array according to the present invention.

FIG. 7 shows an antenna radiation pattern of an exemplary specific embodiment of an antenna array 1 according to the present invention.

The antenna radiation pattern of FIG. 7 shows the antenna radiation pattern of a dual-fed antenna element 2, 2-1, 2-2, 2-3 according to the present invention in the case of a destructive superimposition.

In the antenna radiation pattern of FIG. 7, the radiation angle theta of −100° to +100° is plotted on the X-axis. In addition, the antenna gain of −40 dBi to +15 dBi is plotted in dBi on the Y-axis.

Plotted in the antenna radiation pattern of FIG. 7 is a curve showing half-sinusoidal waves of between −90° and +90° and illustrating the antenna gain. The destructive interference of the two signals becomes especially evident at an angle of 0°. Here, the curve descends to approximately −38 dBi.

Figure 8:
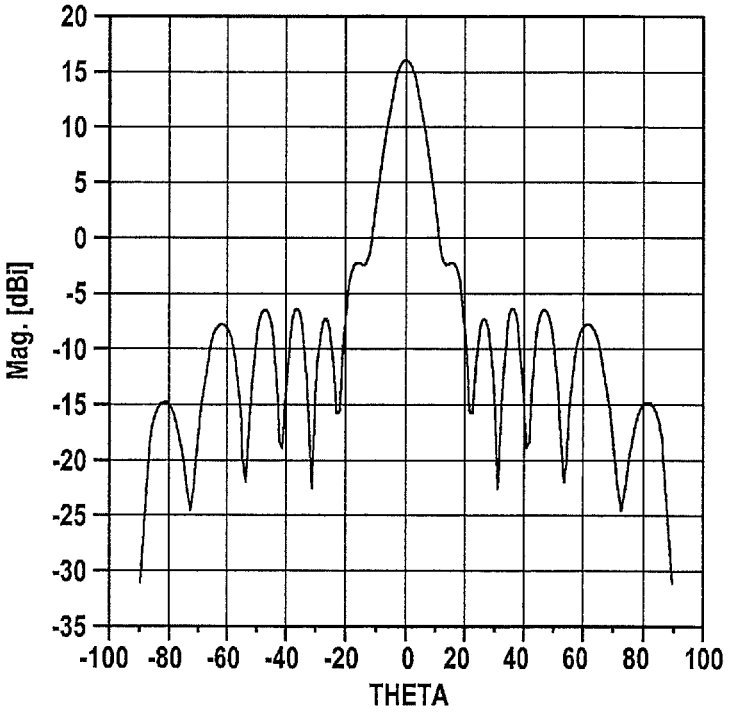
FIG. 8 shows another antenna radiation pattern of another exemplary specific embodiment of an antenna array according to the present invention.

FIG. 8 shows another antenna radiation pattern of another exemplary specific embodiment of an antenna array according to the present invention.

In contrast to FIG. 7, the antenna radiation pattern of FIG. 8 shows the antenna radiation pattern of a dual-fed antenna element 2, 2-1, 2-2, 2-3 according to the present invention in the case of a constructive superimposition.

In the same way as in FIG. 7, the radiation angle theta of −100° to +100° is plotted on the X-axis in the antenna radiation pattern of FIG. 8. In addition, the antenna gain in dBi of −40 dBi to +20 dBi is plotted on the Y-axis.

Likewise discernible in the antenna radiation pattern of FIG. 8 is a curve showing half-sinusoidal waves of between −90° and +90°, respectively, and illustrating the antenna gain. The constructive interference of the two signals becomes especially evident at an angle of 0°. Here, the curve shows a maximum gain of approximately 17 dBi.

Figure 9:
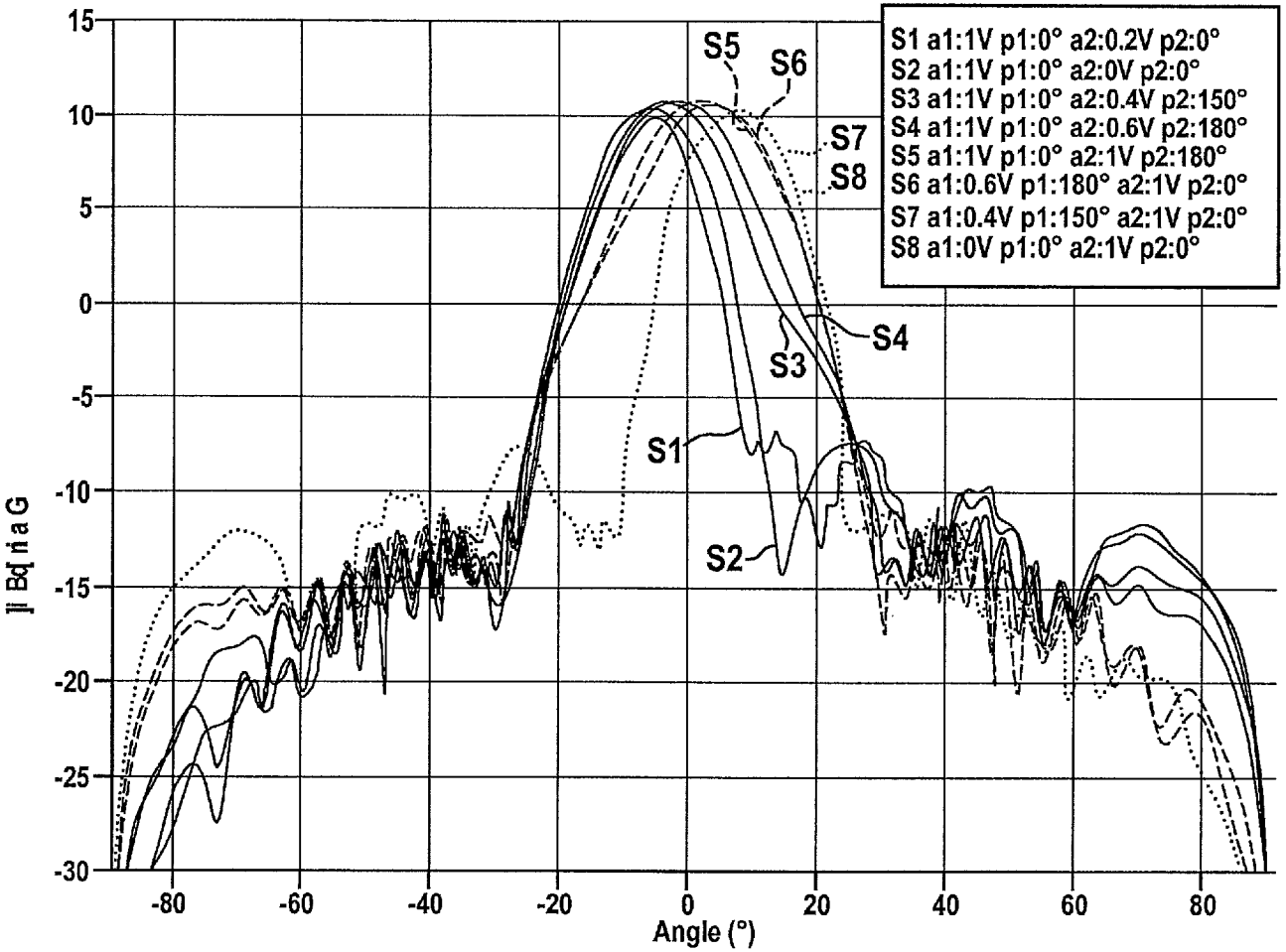
FIG. 9 shows another antenna radiation pattern of another exemplary specific embodiment of an antenna array according to the present invention.

FIG. 9 shows another antenna radiation pattern of another exemplary specific embodiment of an antenna array according to the present invention.

The antenna radiation pattern of FIG. 9 corresponds to that of an antenna element in accordance with FIG. 5.

In the antenna radiation pattern of FIG. 9, the radiation angle of −90° to +90° is plotted on the X-axis. In addition, the antenna gain of −30 dBi to +15 dBi is plotted in dBi on the Y-axis.

Finally, in the antenna radiation pattern of FIG. 9, eight different signal curves S1 through S8 are shown that each represent the antenna radiation pattern of antenna element 2 in accordance with FIG. 5 at different amplitudes and phase angles of the feed signal.

The first feed signal for first signal curve S1 has an amplitude of 1 volt and a phase angle of 0°. The second feed signal for first signal curve S1 has an amplitude of 0.2 volt and a phase angle of 0°.

In addition, the first feed signal for second signal curve S2 has an amplitude of 1 volt and a phase angle of 0°. The second feed signal for second signal curve S2 has an amplitude of 0 volt and a phase angle of 0°.

In addition, the first feed signal for third signal curve S3 has an amplitude of 1 volt and a phase angle of 0°. The second feed signal for third signal curve S3 has an amplitude of 0.4 volt and a phase angle of 150°.

In addition, the first feed signal for fourth signal curve S4 has an amplitude of 1 volt and a phase angle of 0°. The second feed signal for fourth signal curve S4 has an amplitude of 0.6 volt and a phase angle of 180°.

In addition, the first feed signal for fifth signal curve S5 has an amplitude of 1 volt and a phase angle of 0°. The second feed signal for fifth signal curve S5 has an amplitude of 1 volt and a phase angle of 180°.

In addition, the first feed signal for sixth signal curve S6 has an amplitude of 0.6 volt and a phase angle of 180°. The second feed signal for sixth signal curve S6 has an amplitude of 1 volt and a phase angle of 0°.

In addition, the first feed signal for seventh signal curve S7 has an amplitude of 0.4 volt and a phase angle of 150°. The second feed signal for seventh signal curve S7 has an amplitude of 1 volt and a phase angle of 0°.

Finally, the first feed signal for eighth signal curve S8 has an amplitude of 0 volt and a phase angle of 0°. The second feed signal for eighth signal curve S8 has an amplitude of 1 volt and a phase angle of 0°.

All of the curves ascend approximately from −90° to approximately −30° from −30 dBi to approximately −12 dBi. In the same way, all descend from approximately +30° to 90° from approximately −12 dBi to −30 dBi.

It is clearly discernible in all of the curves that the particular maximum of the corresponding curves is offset from the 0° angle. The maximum of first curve S1 resides at approximately −10°. The maximum of second curve S2 resides at approximately −8°. The maximum of third curve S3 resides at approximately −6°. The maximum of fifth curve S4 resides at approximately −3°. The maximum of fifth curve S5 resides at approximately +3°. The maximum of sixth curve S6 resides at approximately +6°. The maximum of seventh curve S7 resides at approximately +8°. The maximum of eighth curve S8 resides at approximately 10°.

In FIG. 9, it becomes apparent that a matching of the phase and amplitude differences between the two feed signals may be utilized to adjust the antenna radiation pattern of an array antenna. The antenna radiation pattern is derived from the following analytical model:

$$\text{Total radiation} = EF1 \times AF1 + EF2 \times AF2$$

$$EF1 = EF2 = "F$$

$$AF1 = \sum_{i=1}^{M} a_i \exp\left(\frac{-j2\pi\sin(\theta_i)}{\lambda_0}\right)$$

$$AF2 = \sum_{i=1}^{M} a_i \exp\left(\frac{j2\pi\sin(\theta_i)}{\lambda_0}\right).$$

EF1 stands for the element factor when the antenna element is fed via first feed terminal 3.

In addition, AF1 stands for the array factor when the antenna element is fed via first feed terminal 3.

In addition, EF2 stands for the element factor when the antenna element is fed via second feed terminal 4.

In addition, AF2 stands for the array factor when the antenna element is fed via second feed terminal 4.

In addition, θ stands for the beam direction of the main radiation; $a_n$ for the excitation of each individual transmitting element 10 of array antenna element 2; d for the distance between two transmitting elements 10; and M for the number of transmitting elements 10 in array antenna element 2.

Figure 10:
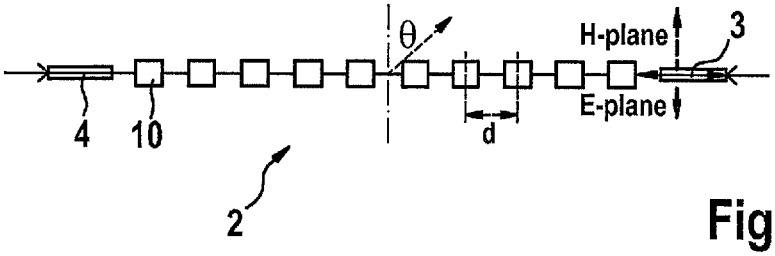
FIG. 10 shows a block diagram of an exemplary specific embodiment of an antenna element according to the present invention.

FIG. 10 shows the configuration of an exemplary specific embodiment of an antenna element 2 according to the present invention for further illustration of the analytical model described in the context of FIG. 9.

Antenna element 2 in FIG. 10 features ten serially disposed transmitting elements 10 that are electroconductively interconnected. For the sake of clarity, merely one of transmitting elements 10 is provided with a reference numeral. In addition, in FIG. 10, antenna element 2 features a first feed terminal 3 at the right end thereof and a second feed terminal 4 at the left end thereof. In addition, distance d is marked in FIG. 10. It characterizes the spacing between two of the midpoints of two transmitting elements 10.

Also marked in the middle of antenna element 2 is angle θ that characterizes the direction of the main radiation of antenna element 2. Finally marked in FIG. 10 are the coordinate axes, the X-axis of the coordinate axes being disposed in parallel to the series of transmitting elements 10. The E-plane denotes the sectional plane of the antenna radiation pattern in the direction of the electrical field components (here horizontal); the H-plane denotes the sectional plane of the antenna radiation pattern orthogonally thereto (here vertical).

Figure 11:
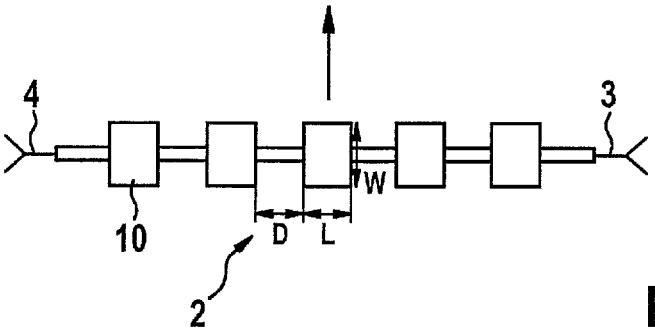
FIG. 11 shows a block diagram of another exemplary specific embodiment of an antenna element according to the present invention.
Figure 12:
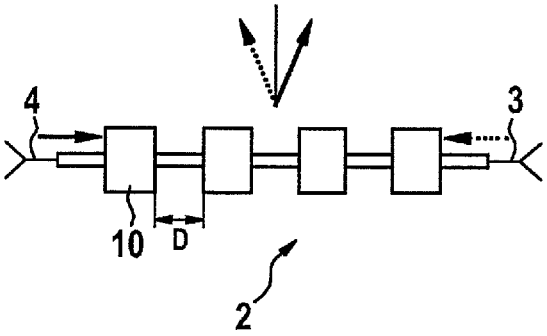
FIG. 12 shows a block diagram of another exemplary specific embodiment of an antenna element according to the present invention.
Figure 13:
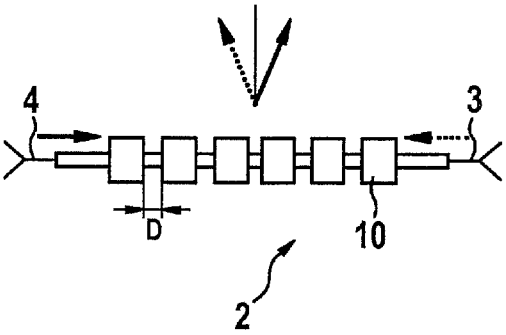
FIG. 13 shows a block diagram of another exemplary specific embodiment of an antenna element according to the present invention.

To illustrate the present invention, FIG. 11 through 13 each show one antenna element 2. Antenna elements 2 in FIG. 11 through 13 each feature five transmitting elements 10, a first feed terminal 3, as well as a second feed terminal 4.

In FIG. 11, distance D between individual transmitting elements 10 corresponds to half of the wavelength of the injected signal. From this, it follows that the main radiation of the antenna takes place in the direction that is normal to the series of transmitting elements 10. This is illustrated by an arrow that extends perpendicularly from the series of transmitting elements 10.

In FIG. 12, distance D between individual transmitting elements 10 is greater than half of the wavelength of the signal injected at first and second feed terminal 3, 4. From this, it is derived that the two signals are not emitted at a normal angle, rather at an angle (other than normal) relative to the orthogonal radiation. An emission is produced by the signal that is injected at first (right) feed terminal 3 and forms a negative angle relative to the normal to the series of transmitting elements 10, thus a counterclockwise rotated angle. In the same way, an emission is produced by the signal that is injected at the second (left) feed terminal 4 and forms a positive angle relative to the normal to the series of transmitting elements 10, thus a clockwise rotated angle.

Finally, in FIG. 13, an antenna element 2 is shown where distance D between individual transmitting elements 10 is smaller than half of the wavelength of the signal injected at first and second feed terminal 3, 4. An effect that is the inverse of that of FIG. 12 is to be observed in FIG. 13 where an emission is produced by the signal that is injected at the first (right) feed terminal 3 and forms a positive angle relative to the normal to the series of transmitting elements 10, thus a clockwise rotated angle. In the same way, an emission is produced by the signal that is injected at second (left) feed terminal 4 and forms a negative angle relative to the normal to the series of transmitting elements 10, thus a counterclockwise rotated angle.

Although the present invention is described above on the basis of exemplary embodiments, it is not limited thereto, but rather may be modified in numerous ways. In particular, the present invention may be modified in various ways without departing from the spirit and scope thereof.

What is claimed is:

1. An antenna array having an adjustable radiation pattern, comprising:

an antenna element that includes a first feed terminal at a first end of the antenna element, a second feed terminal at a second end of the antenna element, and a plurality of transmitting elements arranged in series between the first and second ends;

a signal generation unit configured to generate a feed signal and to provide the feed signal onto first and second lines leading, respectively, to the first and second feed terminals; and a control unit that is configured to control the antenna element to emit a total signal matching a selected radiation pattern, wherein the control unit:

includes a signal conditioning unit that is electrically arranged between the signal generation unit and the first feed terminal; and is configured to control the antenna element to emit the total signal matching the selected radiation pattern by:

selecting a difference, with respect to at least one of amplitude and phase, between the feed signal on the first line that is input to the first feed terminal and the feed signal on the second line that is input to the second feed terminal; and setting the selected difference, wherein the setting includes the signal conditioning unit modifying the at least one of the amplitude and phase of the feed signal output by the signal generation unit onto the first line prior to input of the feed signal on the first line into the first feed terminal, and wherein the antennal element is configured so that, when the first and second feed terminals each receives the feed signal, the plurality of transmitting elements emit a first partial signal, in a first direction, due to the feed signal at the first feed terminal and a second partial signal, in a second direction that is opposite to the first direction, due to the feed signal at the second feed terminal, the first and second partial signals being superimposed onto each other by their emissions, thereby producing the total signal.

2. The antenna array of claim 1, wherein the array antenna has at least one of a waveguide antenna and a microstrip antenna.

3. The antenna array of claim 1, wherein the feed signal has a frequency that is adapted to the antenna element that allows an electromagnetic wave emitted by the antenna element to have a specified radiation pattern.

4. The antenna array of claim 1, wherein the signal conditioning unit includes a variable phase shifter.

5. The antenna array of claim 1, wherein the signal conditioning unit includes a variable amplifier.

6. The antenna array of claim 1, wherein the antenna array includes a traveling-wave antenna array.

7. The antenna array of claim 1, wherein the second feed terminal is connected to the signal generation unit without any signal conditioning unit that is configured to modify the feed signal being arranged between the second feed terminal and the signal generation unit, so that the second feed terminal received the feed signal generated by the signal generation unit without any modification to the feed signal whenever the signal generation unit generates the feed signal.

8. A method for operating an antenna array that includes a first feed terminal, a second feed terminal, and a plurality of transmitting elements that are arranged in series between the first and second feed terminals, the method comprising:

generating a feed signal; and controlling the antenna array to emit a total signal matching a selected radiation pattern by:

selecting a difference, with respect to at least one of amplitude and phase, between the generated feed signal as input to the first feed terminal and as input to the second feed terminal; and generating the selected difference, wherein the setting of the selected difference includes, based on the selected difference, modifying the at least one of the amplitude and phase of the generated feed signal and inputting the modified version of the feed signal into the first feed terminal so that the feed signal is different at the first feed terminal than at the second feed terminal, wherein the input of the feed signal into the first feed terminal causes the plurality of transmitting elements to emit a first partial signal in a first direction, the input of the feed signal into the second feed terminal causes the plurality of transmitting elements to emit a second partial signal in a second direction that is opposite the first direction, and the emissions of the first and second partial signals cause the first and second partial signals to be superimposed onto each other, thereby producing the total signal.

9. The method of claim 8, wherein the feed signal is generated with a frequency that is adapted to the antenna element that allows the electromagnetic wave produced by the feed signal injected at the first feed terminal and at the second feed terminal and radiated by the antenna array to have the selected radiation pattern.

* * * * *